US009468804B2

(12) United States Patent
Knox

(10) Patent No.: US 9,468,804 B2
(45) Date of Patent: Oct. 18, 2016

(54) PUSH-UP BAR ASSEMBLY

(71) Applicant: Talan A. Knox, Cottonwood Heights, UT (US)

(72) Inventor: Talan A. Knox, Cottonwood Heights, UT (US)

( * ) Notice: Subject to any disclaimer, the term of this patent is extended or adjusted under 35 U.S.C. 154(b) by 0 days.

(21) Appl. No.: 14/193,240

(22) Filed: Feb. 28, 2014

(65) Prior Publication Data

US 2014/0349823 A1 Nov. 27, 2014

Related U.S. Application Data

(60) Provisional application No. 61/824,036, filed on May 16, 2013.

(51) Int. Cl.

| | |
|---|---|
| ***A63B 23/12*** | (2006.01) |
| ***A63B 22/18*** | (2006.01) |
| ***A63B 22/16*** | (2006.01) |
| ***A63B 22/14*** | (2006.01) |
| ***A63B 21/00*** | (2006.01) |

(52) U.S. Cl.

CPC ..... *A63B 23/1236* (2013.01); *A63B 21/0004* (2013.01); *A63B 22/14* (2013.01); *A63B 22/16* (2013.01); *A63B 22/18* (2013.01); *A63B 23/12* (2013.01)

(58) Field of Classification Search

CPC ..... A63B 23/1236; A63B 26/003; A63B 21/068; A63B 21/22; A63B 21/00127; A63B 21/0608; A63B 21/1496; A63G 11/00

See application file for complete search history.

(56) References Cited

U.S. PATENT DOCUMENTS

| | | | | |
|---|---|---|---|---|
| 4,319,746 | A * | 3/1982 | Chang | A63G 11/00 472/4 |
| 5,549,536 | A | 8/1996 | Clark | |
| 5,713,823 | A | 2/1998 | Walendzak et al. | |
| 5,752,903 | A * | 5/1998 | Chang | 482/141 |
| 5,961,430 | A | 10/1999 | Zuckerman et al. | |
| 6,048,294 | A | 4/2000 | Formanek | |
| 6,129,651 | A | 10/2000 | Denaro | |
| 7,063,646 | B1 | 6/2006 | Slimi | |
| 7,326,153 | B2 | 2/2008 | Bond | |
| 7,481,753 | B2 | 1/2009 | James et al. | |
| 7,553,267 | B1 | 6/2009 | Hauser et al. | |
| 7,713,182 | B2 | 5/2010 | Bizzell et al. | |
| 7,753,831 | B2 | 7/2010 | Langer et al. | |
| 7,951,055 | B2 | 5/2011 | Mulderrig et al. | |
| 7,981,016 | B1 | 7/2011 | Howard | |
| 8,088,052 | B1 | 1/2012 | Sprague | |
| 8,137,251 | B2 | 3/2012 | Tozzi | |
| 8,147,391 | B1 | 4/2012 | Hill | |
| 8,157,713 | B1 | 4/2012 | Siskowic et al. | |
| 2007/0298947 | A1 | 12/2007 | Eksteen | |
| 2010/0197417 | A1* | 8/2010 | May | A63G 11/00 472/106 |
| 2012/0004082 | A1* | 1/2012 | Senegal | 482/141 |
| 2014/0045664 | A1* | 2/2014 | Hockridge et al. | 482/142 |

* cited by examiner

*Primary Examiner* — Oren Ginsberg
*Assistant Examiner* — Jennifer M Deichl
(74) *Attorney, Agent, or Firm* — Geoffrey E. Dobbin; Dobbin IP Law P.C.

(57) ABSTRACT

The present invention is a gimbled push-up bar assembly mounted upon a rotatable hinge, thereby providing instability in three dimensions for which a user will have to compensate in use. The bar may be locked into two dimensions by the use of a lock pin, or may freely move in all three dimensions. Handgrips are provided which are bent downwards to provide guards for a user's hands when in the free-motion configuration. The bar itself is removable from the hinge and stand assembly and may be used as a stable push-up bar assembly, resting on the guards.

4 Claims, 14 Drawing Sheets

FIG. 12
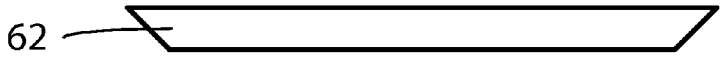
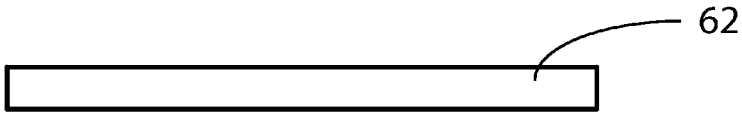
FIG. 13
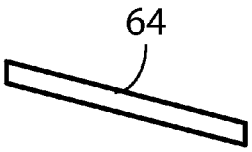
FIG. 14
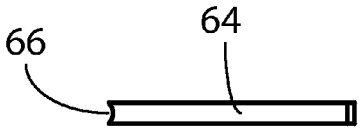
FIG. 15
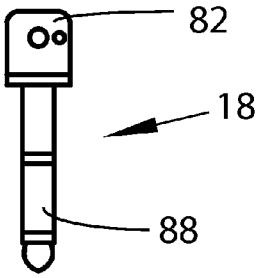
FIG. 16
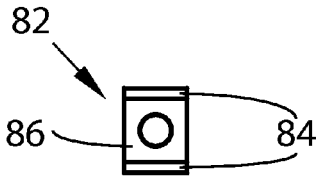
FIG. 18
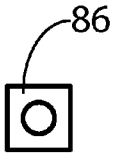
FIG. 19
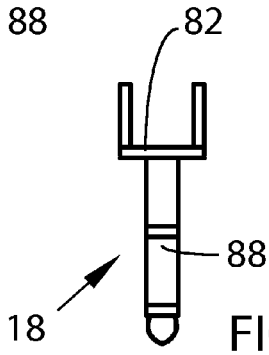
FIG. 17
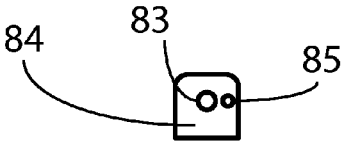
FIG. 20

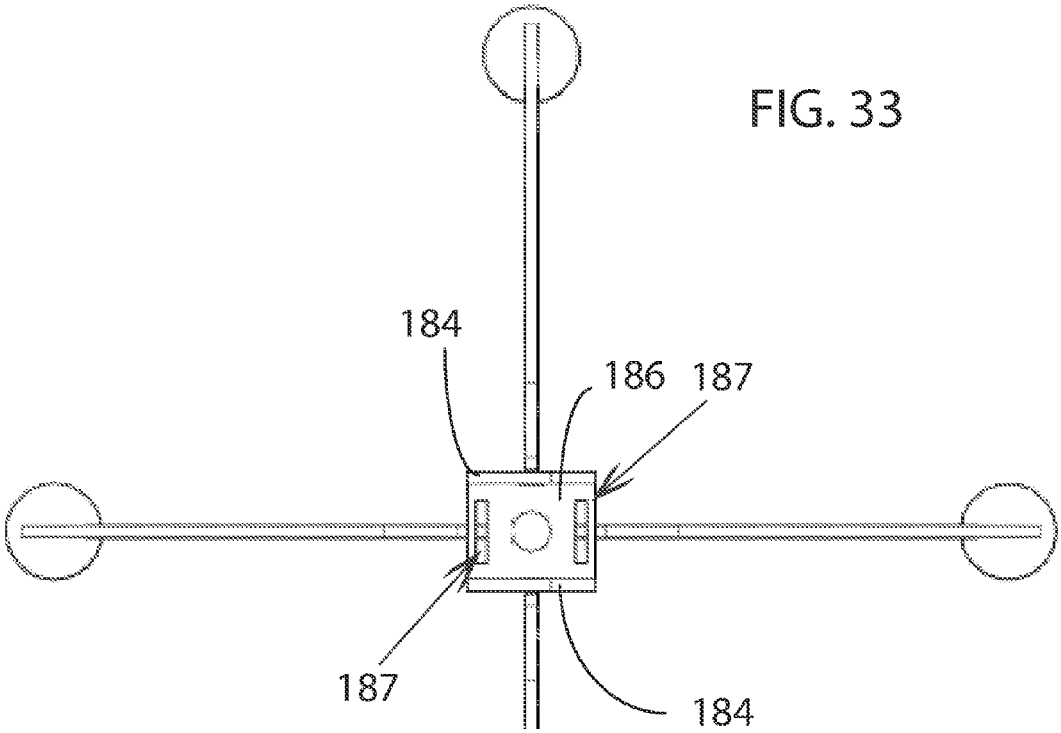
FIG. 33
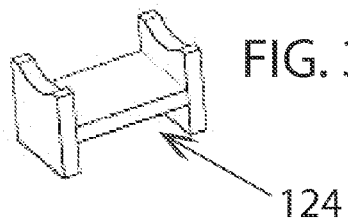
FIG. 34
FIG. 35
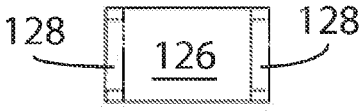
FIG. 36
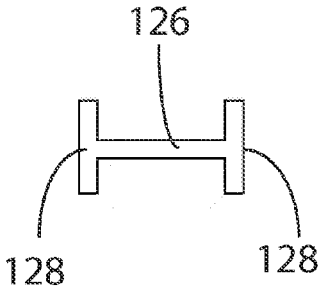
FIG. 37
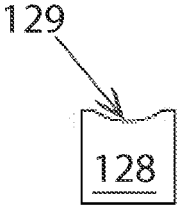

PUSH-UP BAR ASSEMBLY

CROSS-REFERENCES TO RELATED APPLICATIONS

This Application claims priority on prior filed U.S. provisional application No. 61/824,036, filed May 16, 2013, and incorporates the same by reference herein in its entirety.

FIELD OF THE INVENTION

The present invention relates to the field of exercise devices and more particularly relates to a push-up bar assembly adaptable to different styles of push-ups.

BACKGROUND OF THE INVENTION

Physical fitness is an ideal that has been held in high esteem since before humankind became civilized. In earlier days, being fit enabled an individual to better provide and work for a family or tribe. As time advanced, and sedentary lifestyles became more and more common, physical fitness has lost the immediate survival advantage, but has been indicated as a factor in overall health. Also today, athletes train physically regularly in order to maintain optimum and superior performance standards. In order to attain these goals, many devices, machines, appliances and constructs have been developed to engage the human body, or individual parts thereof, in a manner to increase the effectiveness of training.

On family of items that is used as training aids is used for an exercise commonly known as a "push-up". The push-up has a number of forms, but the primary form involves an individual lying prone on a surface and using his or her arms to raise the individual's torso, all the while maintaining a stable and rigid back so that the individual pivots like a lever on his or her toes. The individual then lowers his or her body back towards the surface and repeats the process. The push-up tends to work the arm, shoulder and chest muscles as the motion is repeated and the abdominal and back, or "core," muscles as these muscles are used to maintain proper form against gravity. Various modifications have been developed to increase or decrease the difficulty of a push-up or change the focus of the muscle groups worked in the exercise. Devices used to modify a push-up are usually in two forms: push-up bar assemblies and push-up handles. A push-up bar assembly is a raised bar that is positioned upon the surface, which the individual grasps while doing a push-up. Push-up handles are hand grips which contact the surface under the individual. Usually, either of these devices may be used to impart instability on the individual, and in so doing increase the effort of the core muscles and the arm muscles in order to maintain an appropriate push-up form. However, there has been a lack of simple push-up devices which are adaptable for increased or decreased stability and also for providing an adaptable support for users to then exercise specific muscle groups like the shoulders, which are heavily used in various styles of wrestling and other sports.

The present invention is a push-up bar assembly that is eccentrically mounted in a manner to provide instability and adaptability to an individual when preforming a push-up. The bar is mounted upon a pivot hinge located upon a base in a manner to allow free rotation along a z-axis. It is also pivotably mounted in the pivot hinge so as to allow rotation about an x-axis. This second rotational direction may be blocked by a pin so that only rotation about the z-axis is possible. Handgrips may be provided to the bar so that different hand holds may be employed and thereby modify the basic exercise to target individual body parts, such as the shoulder region.

The present invention represents a departure from the prior art in that the push-up bar assembly of the present invention allows for greater versatility in an individual user's exercise routine. It allows an individual user to determine a degree of instability in the bar so as to encourage the exercise of core and other muscles as the user maintains stability and also allows for various styles and techniques to be used in performing push-up exercises and in so doing the targeting of specific muscle groups.

SUMMARY OF THE INVENTION

In view of the foregoing disadvantages inherent in the known types of push-up bar assemblies, this invention provides an adaptable push-up bar assembly for increased exercise utility. As such, the present invention's general purpose is to provide a new and improved push-up bar assembly that is eccentrically mounted.

To accomplish these objectives, the push-up bar assembly comprises a stable base which may be positioned upon a given surface and a pivot hinge protruding up therefrom. The pivot hinge is mounted in a manner to allow it to rotate about a first axis. A crossbar is mounted within the pivot hinge in a manner to allow it to rotate on a second axis, generally perpendicular to the first axis. This rotation about the second axis may be optionally blocked and handles may be added for user convenience and safety.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways.

Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 12 is a top plan view of a floor beam utilized in the base of FIG. 10.

FIG. 13 is a front elevation of floor beam utilized in the base of FIG. 10.

FIG. 14 is a front elevation of a support beam utilized in the base of FIG. 10.

FIG. 15 is a top plan view of a support beam utilized in the base of FIG. 10.

FIG. 16 is a front elevation of the pivot hinge utilized with the push-up bar assembly of FIG. 1

FIG. 17 is a side elevation of the pivot hinge utilized with the push-up bar assembly of FIG. 1.

FIG. 18 is a top plan view of the cradle of the pivot hinge of FIG. 16.

FIG. 19 is a top plan view of the cradle base of the cradle of FIG. 18.

FIG. 20 is a side elevation of a cradle wall of the cradle of FIG. 18.

FIG. 33 is a partial top plan view of the base or the push-up bar assembly of FIG. 29.

FIG. 34 is a perspective view of the lock block utilized in the push-up bar assembly of FIG. 29.

FIG. 35 is a top plan view of the lock block of FIG. 34.

FIG. 35 is a front elevation of the lock block of FIG. 34.

FIG. 37 is a side elevation of the lock block of FIG. 34.

DETAILED DESCRIPTION OF THE PREFERRED EMBODIMENT

With reference now to the drawings, the preferred embodiment of the push-up bar assembly is herein described. It should be noted that the articles "a", "an", and "the", as used in this specification, include plural referents unless the content clearly dictates otherwise.

Figure 1:
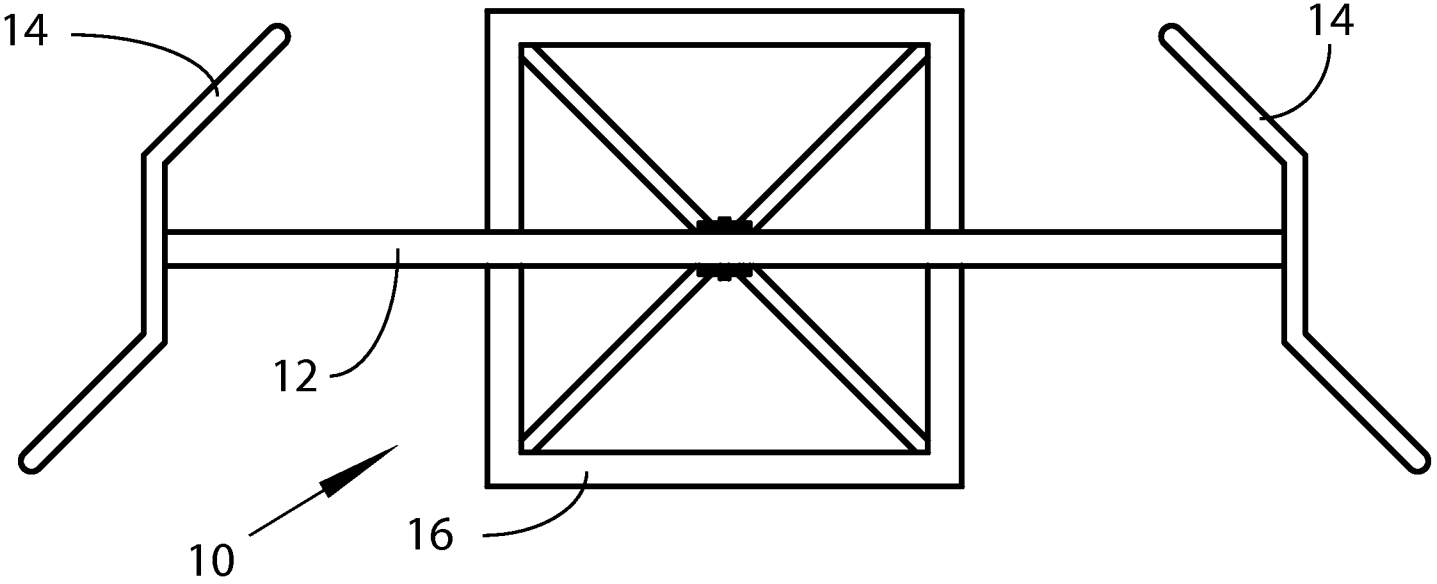
FIG. 1 is a top plan view of the push-up bar assembly.
Figure 2:
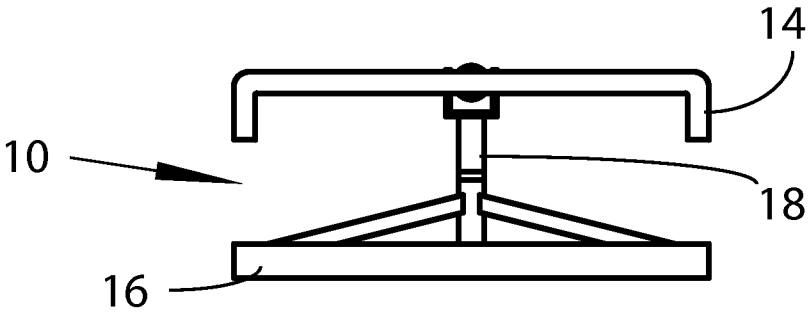
FIG. 2 is a side elevation of the push up bar of FIG. 1.
Figure 3:
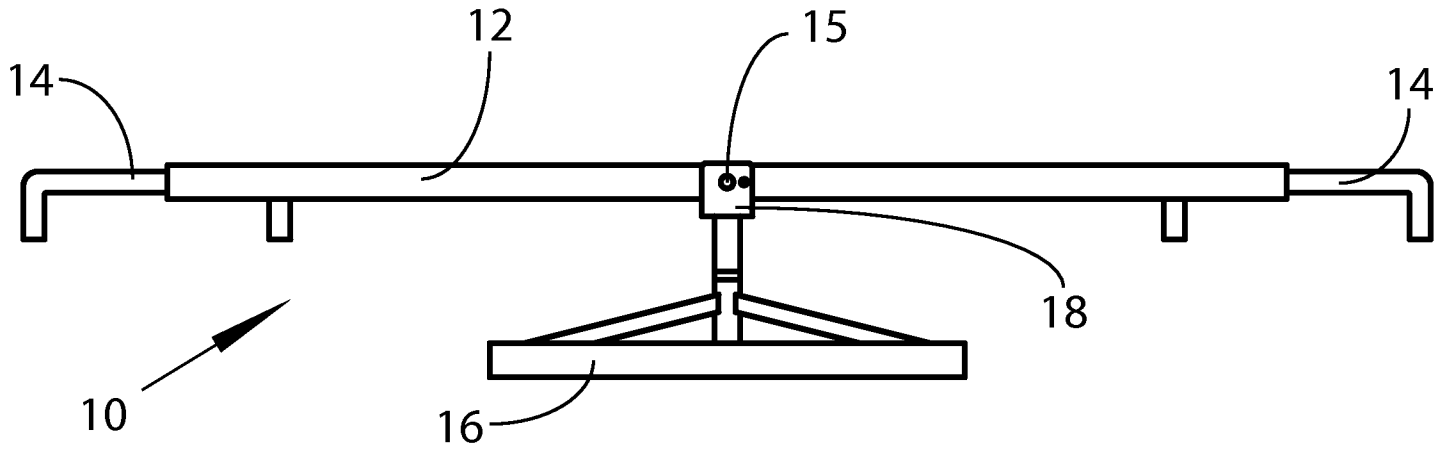
FIG. 3 is a front elevation of the push-up bar assembly of FIG. 1.
Figure 4:
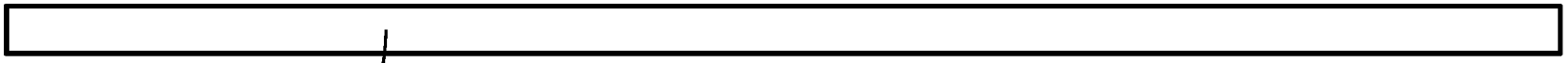
FIG. 4 is a top plan view of the cross-bar utilized in the push-up bar assembly of FIG. 1.
Figure 5:
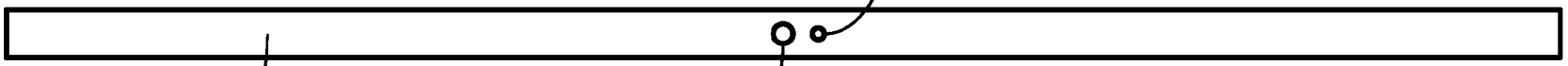
FIG. 5 is a front elevation of the cross-bar utilized in the push-up bar assembly of FIG. 1.
Figure 6:
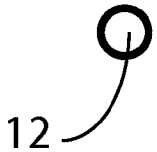
FIG. 6 is a side elevation of the cross-bar utilized in the push-up bar assembly of FIG. 1.
Figure 7:
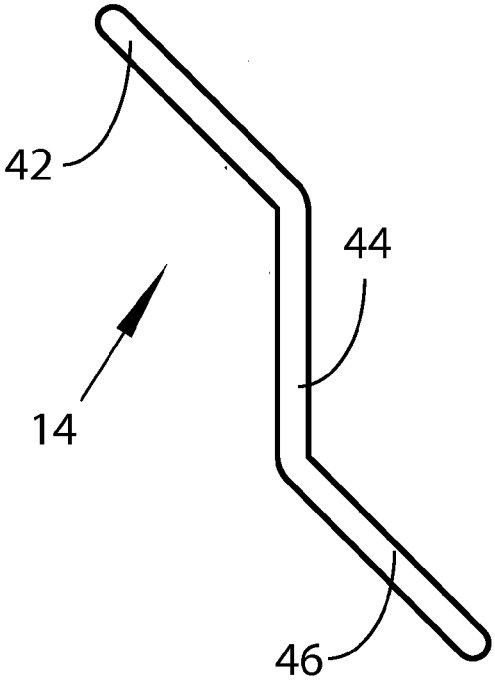
FIG. 7 is a top plan view of a handle bar utilized in the push-up bar assembly of FIG. 1.
Figure 8:
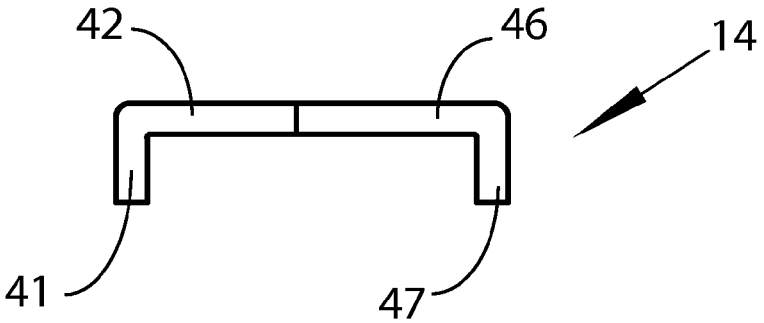
FIG. 8 is a front elevation of a handle bar utilized in the push-up bar assembly of FIG. 1.
Figure 9:
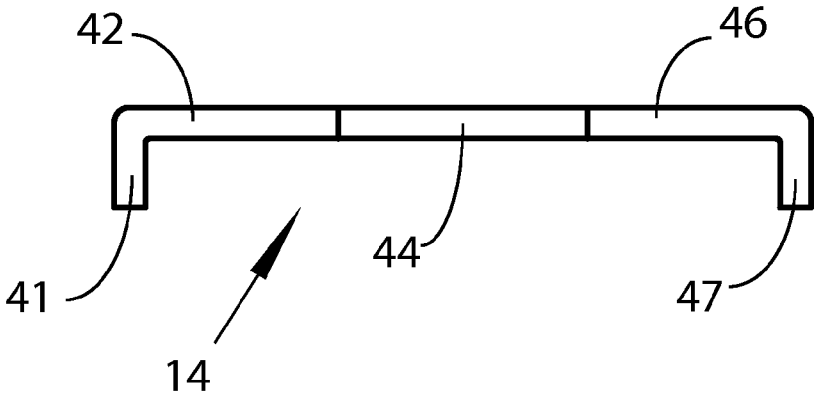
FIG. 9 is a side elevation of a handle bar utilized in the push-up bar assembly of FIG. 1.
Figure 10:
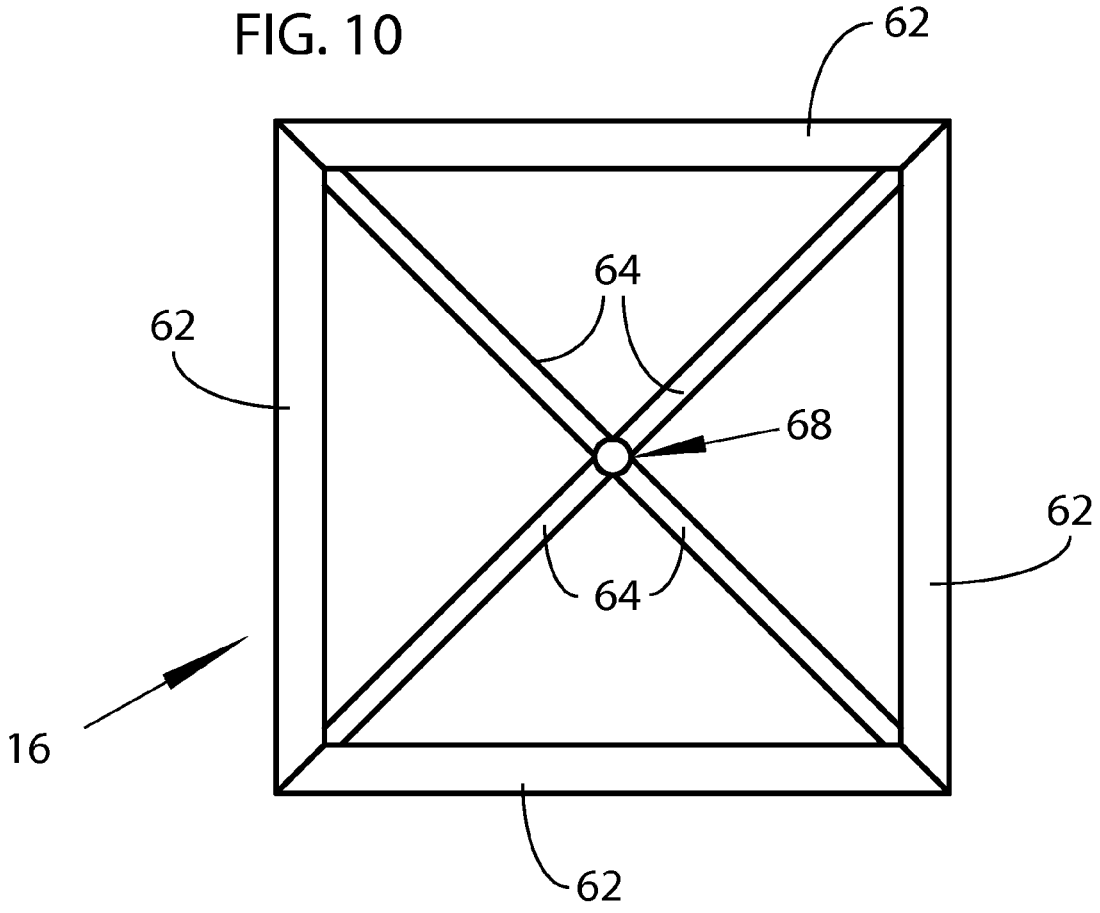
FIG. 10 is a top plan view of the base utilized in the push-up bar assembly of FIG. 1.
Figure 11:
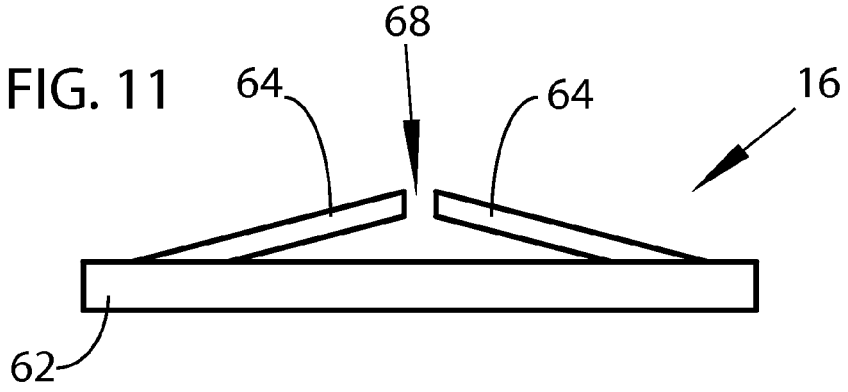
FIG. 11 is a front elevation of the base utilized in the push-up bar assembly of FIG. 1.

With reference to FIGS. 1-3, the push-up bar assembly 10 has four major components: a cross-bar 12, two optional handles 14 mounted upon opposite ends of the cross-bar 12, the base 16 and the pivot hinge 18. The cross-bar 12, shown in FIGS, 4-6, is a simple, cylindrical bar with two side-by side bores 23,25. Bore 23 is a pivot bore and is positioned, ideally, in the middle of the bar 12. Bore 25 is a lock bore and is located proximately to one side of the pivot bore 23. Ideally, both ends of the cross-bar 12 will feature handles 14. Handles 14 (FIGS. 7-9) may be of any shape, but the preferred handle 14 will have two parallel hand-holds 42,46 extending from opposite ends of the handle body 44. Each hand-hold should terminate in a foot 41,47 that is bent downward from the respective hand-hold 42,46. These feet 41,47 will interact with the surface, either as a support or as a safety block, as the cross-bar 12 rotates upwards and downwards about the push-up bar assembly 10.

The base 16, shown in FIGS. 10-15 may be of any suitable construction so as to hold the pivot hinge 18 and thus the cross-bar 12. One embodiment of the base 16 is a simple square pedestal formed of four floor beams 62 with four support beams 64 emanating from the corners of the pedestal. The support beams 64 each have a concave upper end 66 so as to collectively form a socket 68 in which the hinge pin 18 may be inserted.

The pivot hinge 18, shown in FIGS. 16-20 is a simple cradle 88 mounted upon an axle 82. The axle 88 is inserted in the socket 68 formed by the four support beams 64. This construction then allows the cross-bar 12 to rotate above the base 16. The cradle 82 is formed from three parts, a cradle base 86 and two cradle walls 84. Each cradle wall 84 features a pivot hole 83 and a lock hole 85 which correspond to the pivot bore 23 and lock bore 25 of the cross-bar 12. The cradle may be formed by attaching the cradle base 86 and two cradle walls 84 together, having been formed discretely from each other, or the cradle may start as one piece of material that is bent into the desired shape.

For assembly (FIG. 3), the handles 14 are attached to either end of the cross-bar 12, ideally in a manner that the handles 14 will mirror each other.

The cross-bar 12 is then mounted in the cradle 88 of the pivot hinge 18 by passing a pivot pin 15 through the pivot holes 83 of the cradle and the pivot bore 23 of the cross bar 12 and the pivot pin 15 may then be fastened in a manner that allows the cross-bar 12 to pivot in the cradle 82. After the base 12 is assembled, the pivot hinge 18 is positioned in the socket 68 and, ideally, secured. Padding may be used on the cross-bar 12 for comfort and to limit accidental access to the pivot hinge 18.

Figure 21:
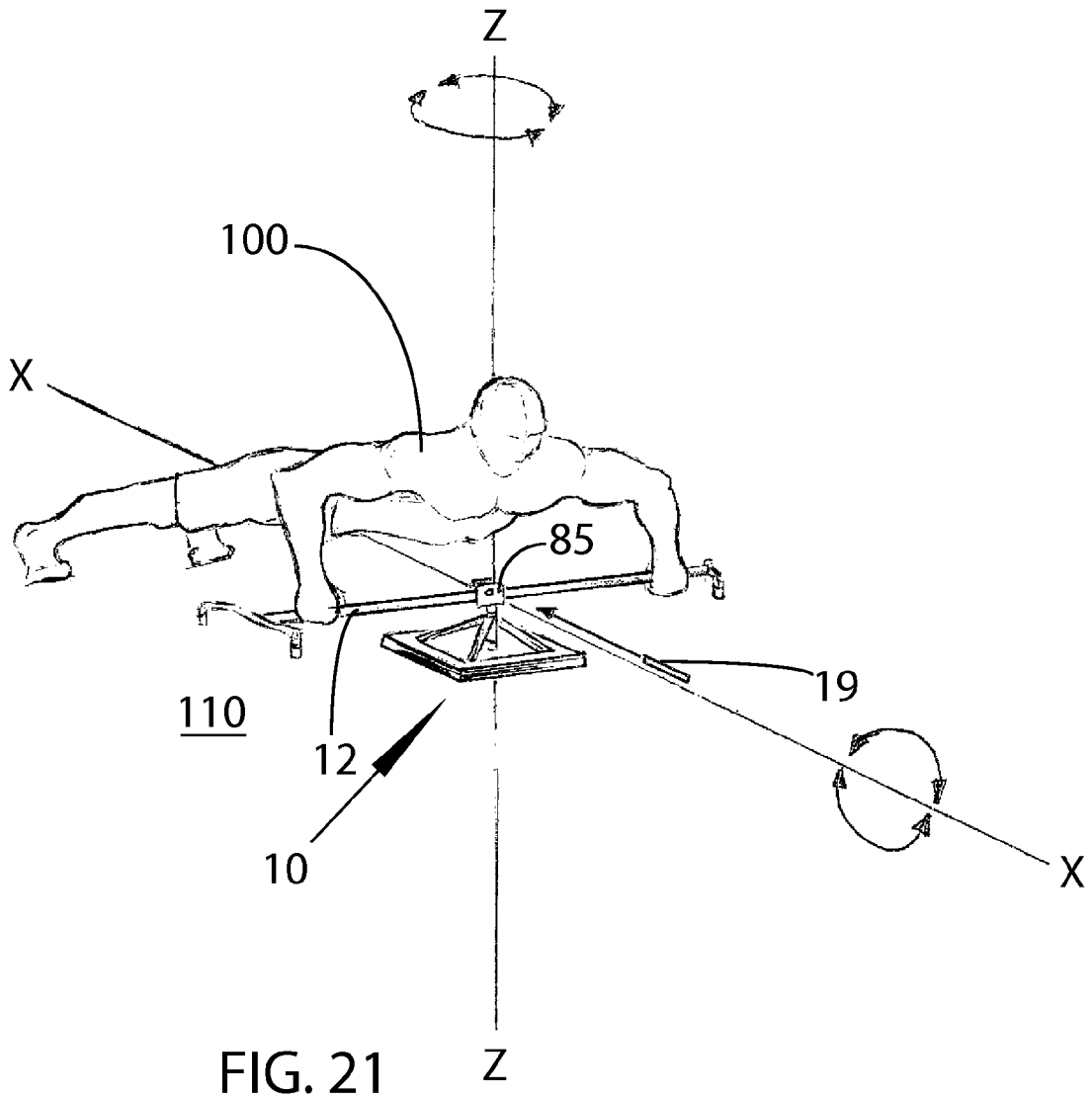
FIGS. 21-28 are various elevation and perspective views of the push-up bar assembly of FIG. 1 in use.
Figure 22:
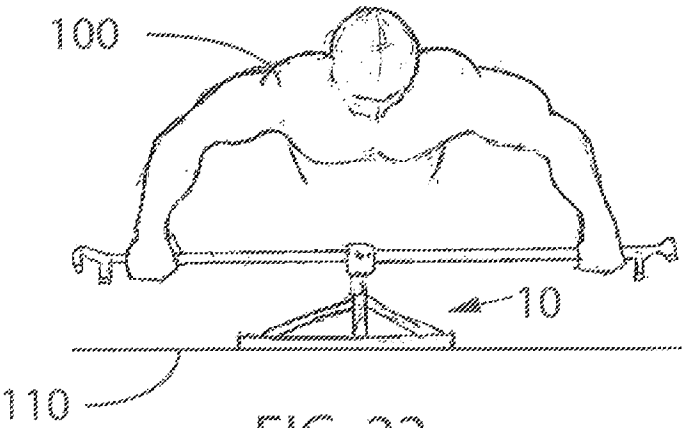
Figure 23:
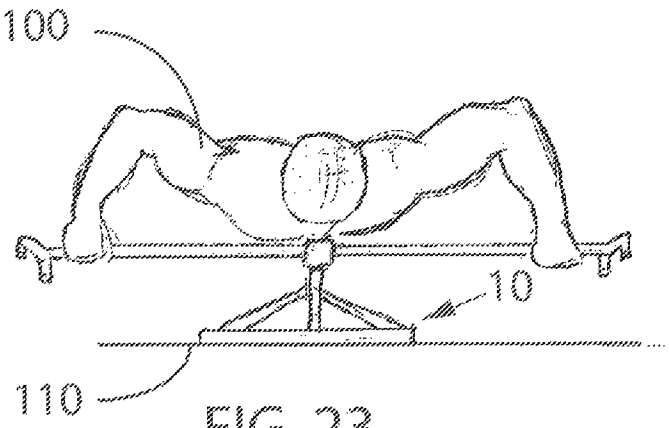
Figure 24:
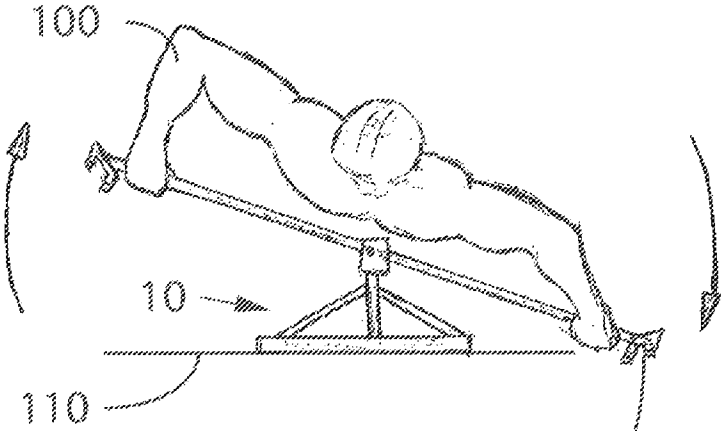
Figure 25:
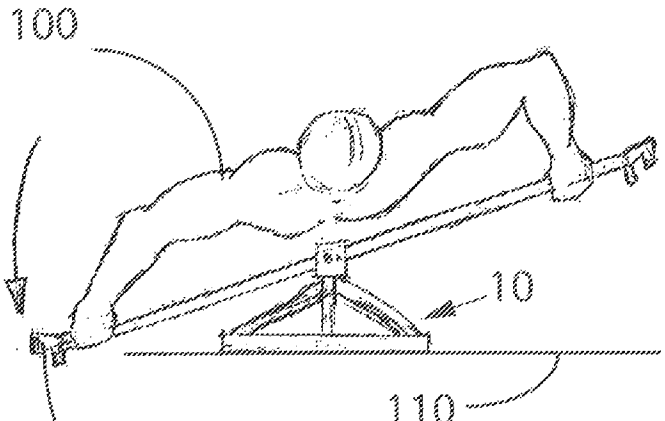
Figure 26:
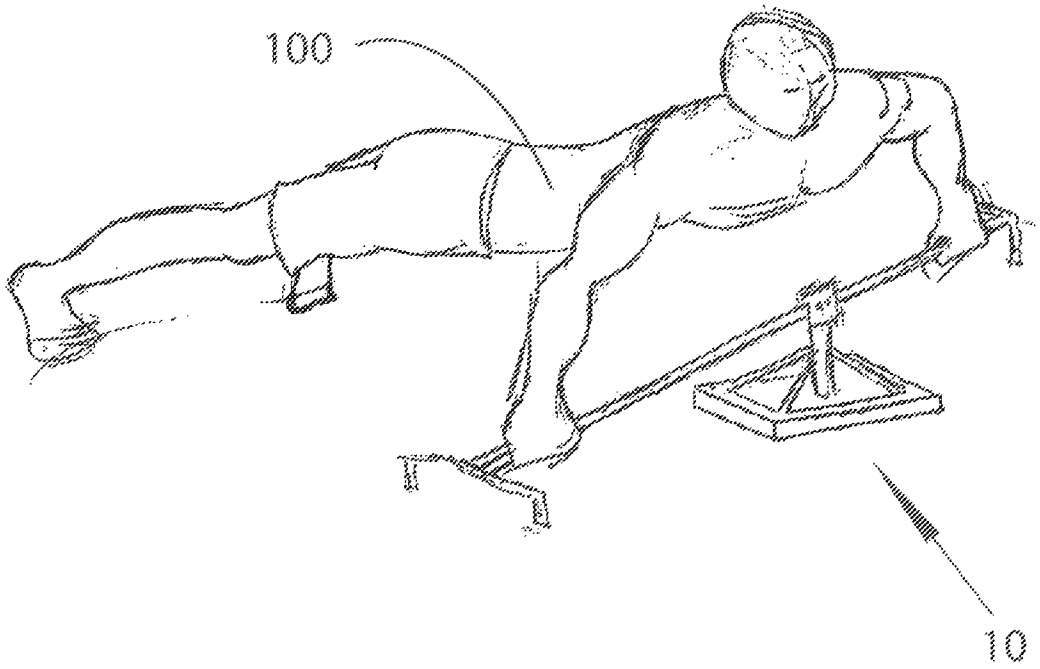
Figure 27:
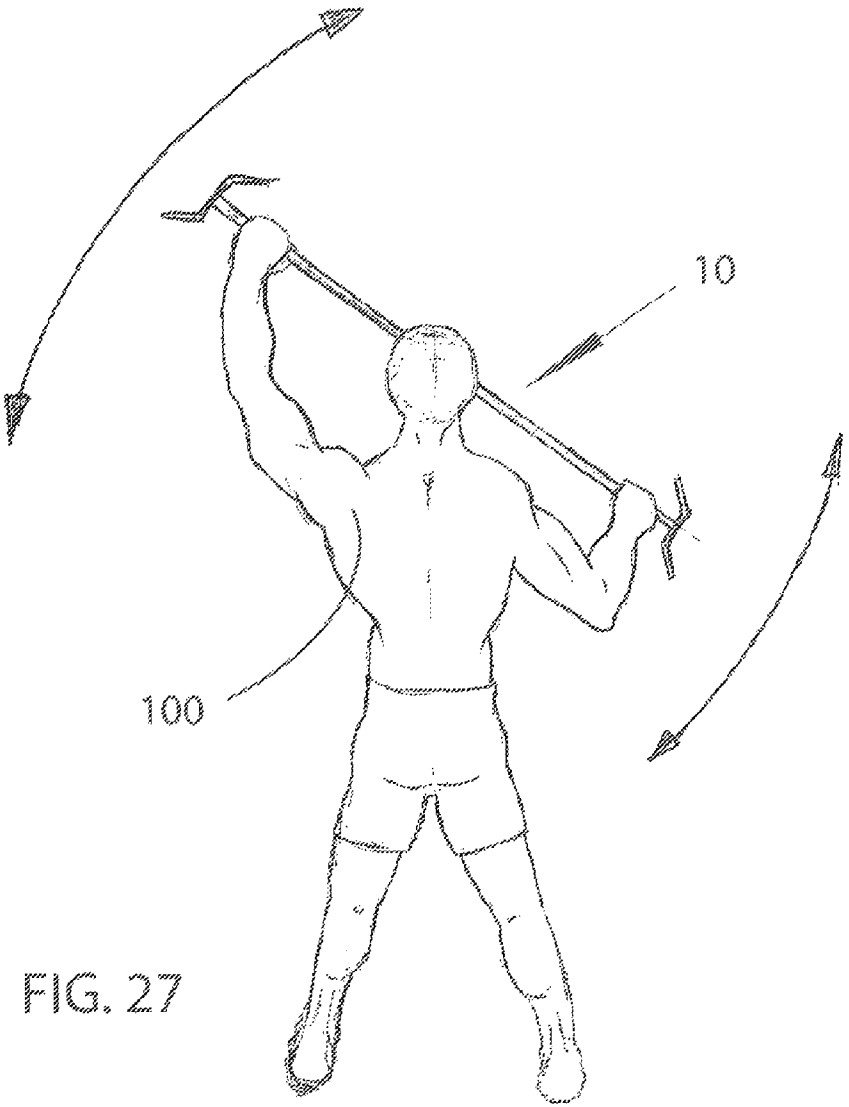
Figure 28:
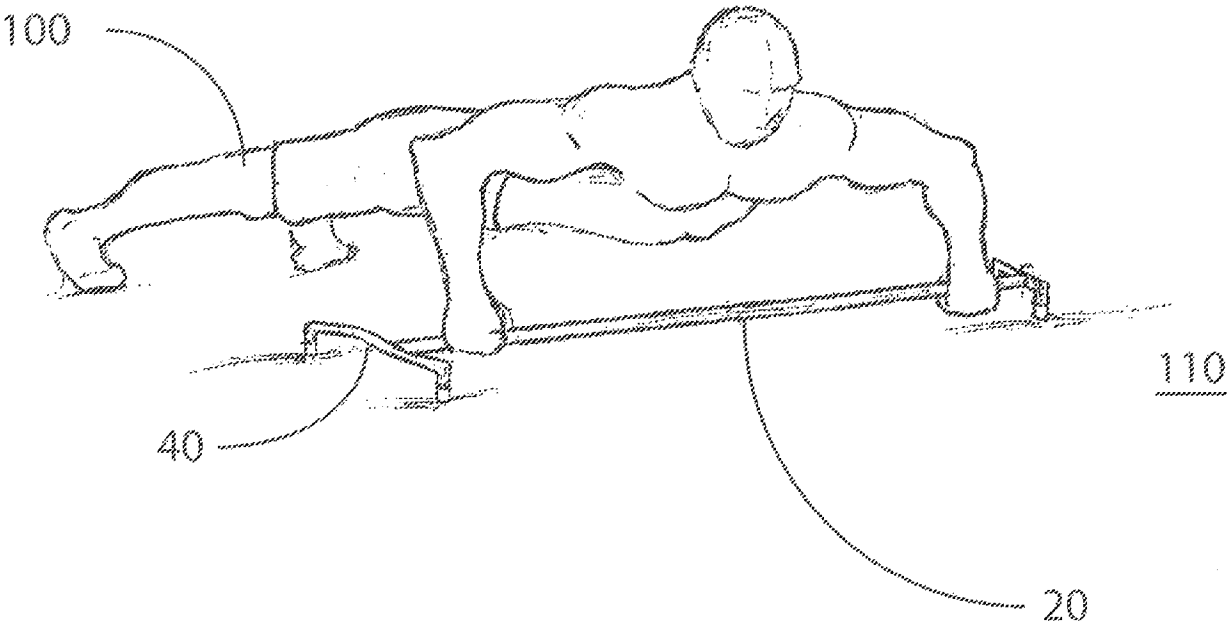
Figure 29:
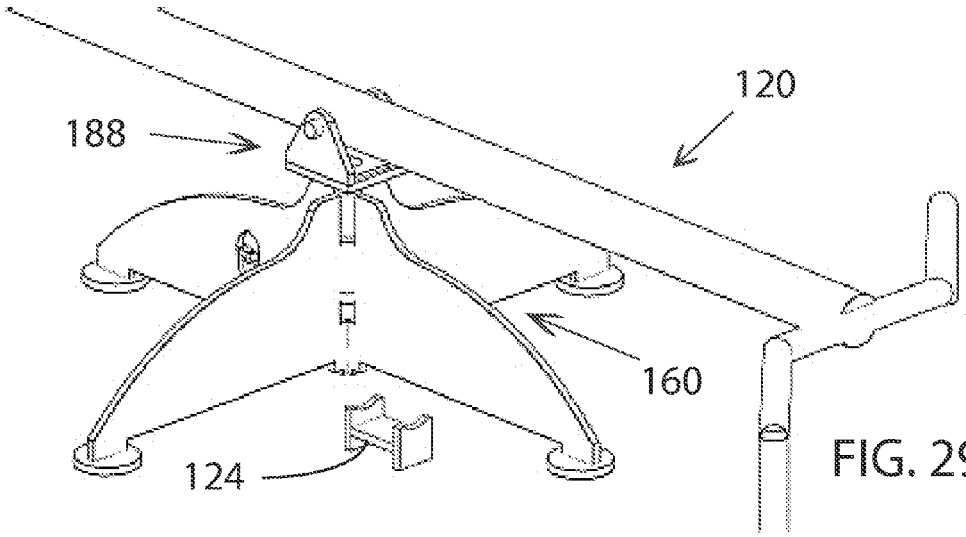
FIG. 29 is a perspective view of an alternate bush-up bar assembly.
Figure 30:
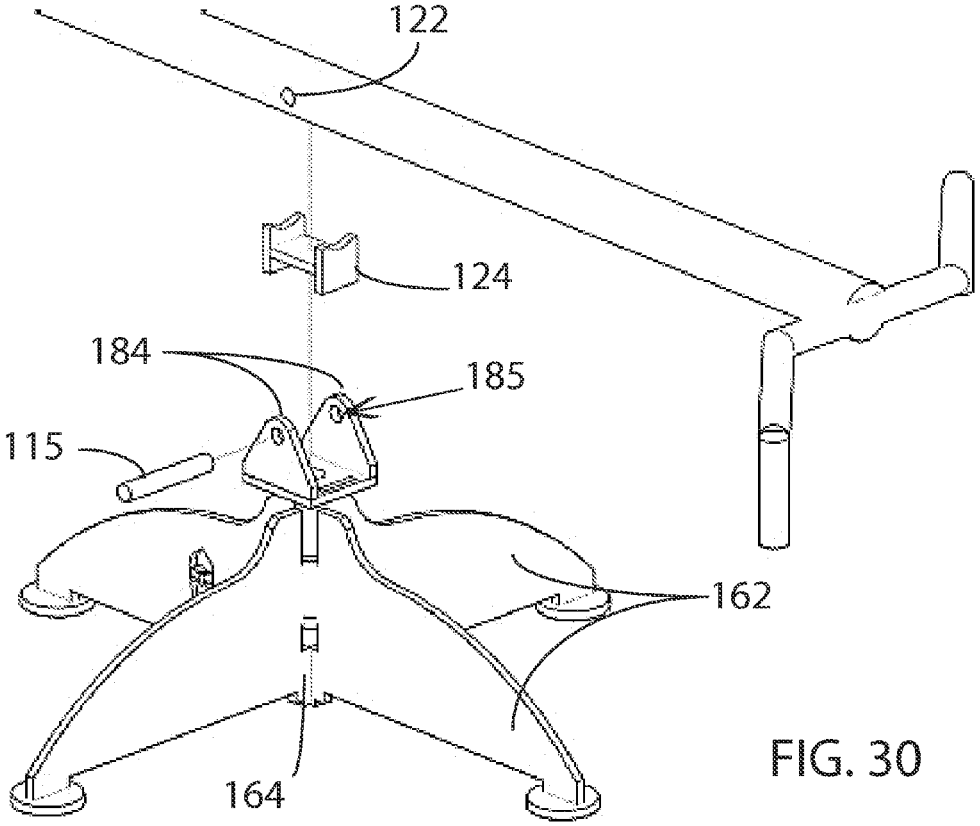
FIG. 30 is an exploded view of the push-up bar assembly of FIG. 29.
Figure 31:
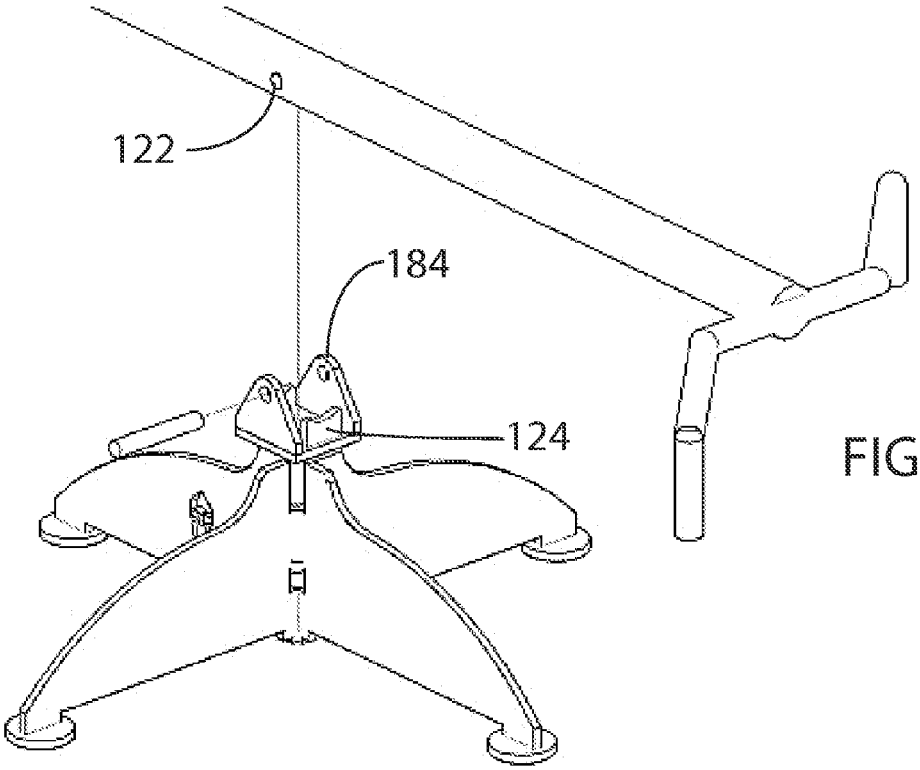
FIG. 31 is an exploded view of the push-up bar assembly of FIG. 29, with a lock block installed.
Figure 32:
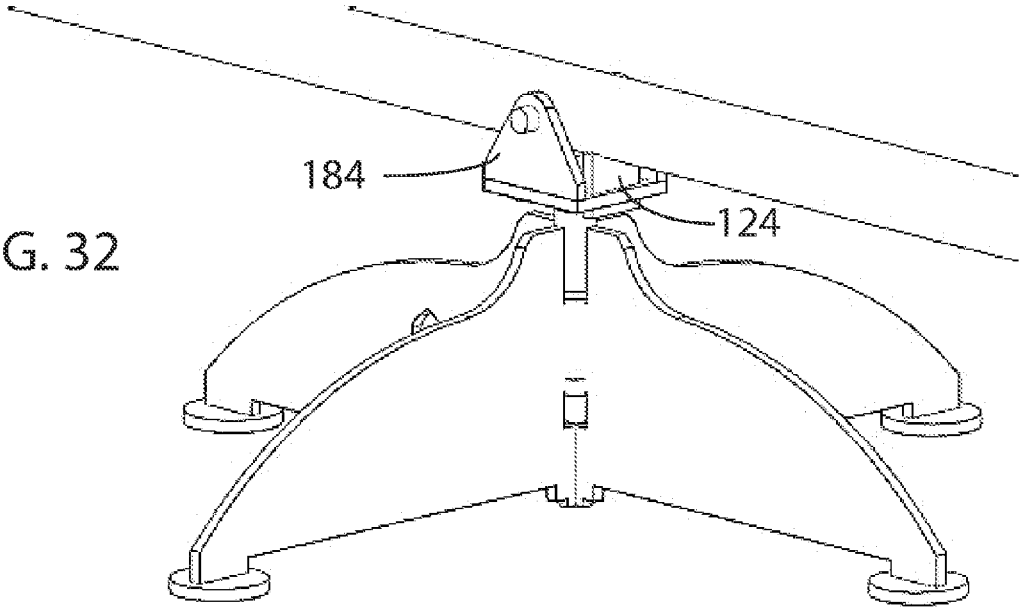
FIG. 32 is a perspective view of the push-up bar assembly of FIG. 29 assembled, with the lock block installed.

In use, (FIG. 21) the push-up bar assembly allows rotational motion about two axes. The first axis, the "Z-axis," is defined by the axle 82 and extends roughly vertically from the center of the push-up bar assembly 10 and is essentially fixed in relation to thereto. The second axis, the "X-axis" is directionally defined by the pivot pin 15 and is directionally similar to the user's body 100. A lock pin 19 may be used to prevent rotation about the X-axis by simply inserting it through the lock holes 85 and the lock bore 25. When locked, a user may execute a common push-up (FIGS. 22 and 23) with little additional difficulty. However, when unlocked, the user 100 must maintain even weight on the cross-bar 12 in order to execute a common push-up. Alternatively, the user 100 may perform push up variants with a cross-bar handle 14 touching the surface 110, so as to focus on the shoulder muscles (FIGS. 24-26). The user 100 may also, whether locked or not, freely rotate the cross-bar 12 about the Z-axis, as shown in FIG. 27. The cross-bar 12 may also be removed from the base 16 and placed directly on the surface 110, supported by feet 41, 47, in an elevated position as a regular push-up stand, FIG. 28.

Construction of the push-up bar assembly is easily accomplished with any suitable sturdy material. The preferred embodiment utilizes tubular steel for the base 16. Cross-bar 12 and handles 14 may be tubular steel or steel rods. The pivot hinge 18 is also ideally formed of metal, such as steel. Each piece may then be powder coated for a finished and polished look and feel. A foam cushion may be positioned over the cross-bar 12, in particular where it joins the pivot hinge 18, so as to cushion and protect the user in the event of accident. The lock pin 19 and pivot axle 15 may be simple metal pins and may be secured to the assembly by any means known or later discovered.

In an alternate embodiment, shown in FIGS. 29-37, a cross-bar 120 has only a pivot bore 122 and a lock block 124 is provided. Lock block 124 (FIGS. 34-37) is essentially a table 126 with two edge legs 128. The edge legs extend below and above the table 126, with the part above the tables terminating in a concave edge 129. An alternate pivot hinge is also provided. Cradle walls 184 only feature a pivot hole 185 while cradle base features two slots 187 for receiving the bottom portion of lock block edge legs 128. In use, the pivot pin 115 is removed from the cross-bar 120 and the cross-bar removed from the cradle 188. Lock block 124 is positioned in the cradle 188 with the lower portion of its edge legs 128 inserted in slots 187. Cross-bar 120 is then returned to position and pivot pin 115 replaced. Cross-bar 120 then rests in the concave edges 129 of the lock block 124 and is prevented from rotation in the x-axis. Lock block 124 is also prevented from being removed from the pivot hinge cradle 188 by the cross-bar 120. By forcing removal of the cross-bar 120 from the assembly in order to lock it in place or unlock it, risk if injury due to pinching by the pivot hinge 180 and cross-bar 120 is reduced. It is, of course, readily understood that instead of merely extending the legs, the entire upper body of the lock block could be a concave surface that would interface the cross-bar 120, but this uses more material.

An alternate base 160 may also be utilized. This alternate base 160 features four intersecting arms 162 with a central support 164 at their intersection. Pivot hinge is positioned in this central support 164 and may or may not be permanently affixed therein. This base should also be made of suitably sturdy materials, such as steel or other metals.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A push-up bar assembly comprising:

a base;

a rotatable hinge mounted upon the base;

a cradle forming a top of said hinge;

a cross-bar removably and pivotably mounted within the cradle such that when the hinge rotates, the cross-bar is capable of motion in three dimensions, and a lock block, insertable between the cross-bar and the cradle in a manner to arrest vertical motion of the cross-bar so that it may only rotate about one axis.

2. The push-up bar assembly of claim 1, the lock block further comprising a plurality of legs and the cradle further comprising a plurality of slots into which the plurality of legs may be positioned.

3. The push-up bar assembly of claim 2, the lock block further comprising at least one concave surface in which the cross-bar may reside.

4. The push-up bar assembly of claim 1, the lock block further comprising at least one concave surface in which the cross-bar may reside.

* * * * *